United States Patent [19]

Beier

[11] 3,965,318

[45] June 22, 1976

[54] CONTACT ARRANGEMENT FOR AN ELECTRIC PRESSURE GAS POWER CIRCUIT BREAKER

[75] Inventor: Helmut Beier, Berlin, Germany

[73] Assignee: Siemens Aktiengesellschaft, Munich, Germany

[22] Filed: Jan. 10, 1975

[21] Appl. No.: 539,951

[30] Foreign Application Priority Data

Feb. 7, 1974 Germany ..... 2406143

[52] U.S. Cl. ..... 200/148 R; 200/146 R; 200/252

[51] Int. Cl.[2] ..... H01H 33/82

[58] Field of Search ..... 200/146 R, 252, 164 R, 200/148 R, 148 B, 148 BV

[56] References Cited

UNITED STATES PATENTS

| | | | |
|---|---|---|---|
| 3,278,711 | 10/1966 | Thuries | 200/252 |
| 3,801,763 | 4/1974 | Marin | 200/148 R |
| 3,854,019 | 12/1974 | Handke | 200/148 R |

*Primary Examiner*—Gerald P. Tolin
*Attorney, Agent, or Firm*—Kenyon & Kenyon Reilly Carr & Chapin

[57] ABSTRACT

A contact arrangement for an electric pressure-gas circuit breaker for interrupting an electric current includes two stationary contact pieces disposed so as to conjointly define a gap therebetween. A follower contact is arranged on one of the contact pieces in insulated relation thereto so as to be movable in a direction toward the other one of said contact pieces. A bridging contact member is movable between first and second positions for electrically joining the contact pieces in the first position and for running off of the one contact piece when moved in the above-mentioned direction toward the other contact piece to the second position thereby electrically separating the contact pieces. An electromagnetic actuator develops a force to propel the follower contact toward the other contact piece during the opening operation of the breaker. A spring associated with the follower contact receives resilient energy as the actuator means propels the follower contact in the direction toward the other contact piece. The follower contact is connected to the current supply for supplying current to the breaker through the electromagnetic actuator to define a bypass conducting path. The follower contact is arranged in the one contact piece so as to cause the bridging contact member to contact the follower contact when the bridging contact member runs off of the one contact piece thereby commutating the current to the bypass conducting path whereby the electromagnetic actuator becomes energized to develop the above-mentioned force.

5 Claims, 1 Drawing Figure

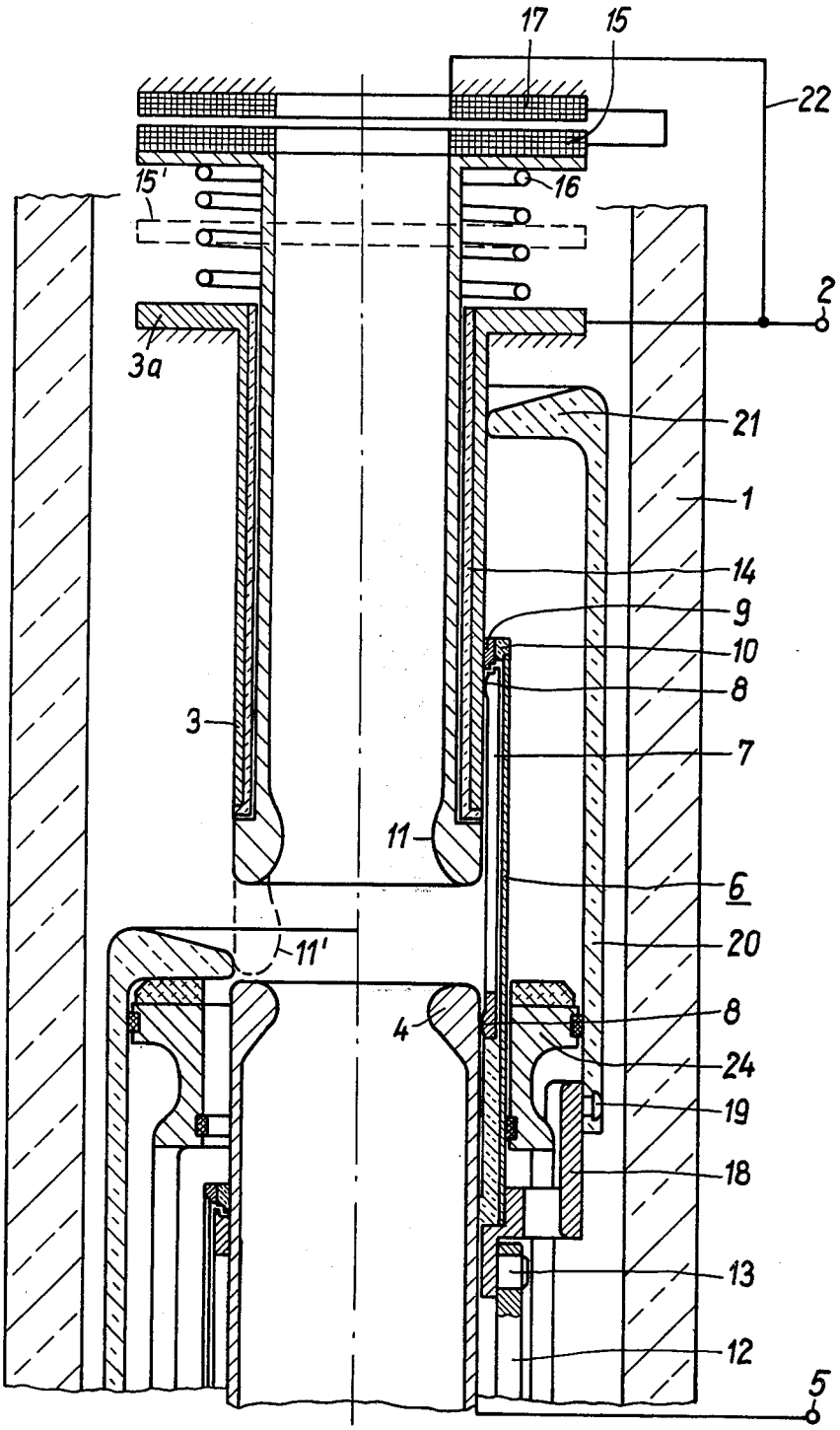
17
15
22
15'
16
2
3a
21
1
14
9
10
8
3
7
11
6
11'
20
8
4
24
19
18
13
12
5

CONTACT ARRANGEMENT FOR AN ELECTRIC PRESSURE GAS POWER CIRCUIT BREAKER

BACKGROUND OF THE INVENTION

The invention relates to an electric compressed-gas circuit breaker with a switching gap defined by two fixed contacts and a bridging contact member which, during the breaking process, runs off of the one fixed contact (run-off contact) and moves in the direction toward the other fixed contact. Such a compressed-gas circuit breaker is disclosed, for example, in Deutsche Offenlegungsschrift No. 2,209,287 wherein the breaker is in the form of a blast-piston breaker (single stage breaker).

It is an object of the invention to reduce the switching energy required in a compressed-gas circuit breaker of the abovementioned type.

SUMMARY OF THE INVENTION

The contact arrangement according to the invention is suitable for an electric pressure-gas circuit breaker for interrupting an electric current. The contact arrangement according to the invention includes two stationary contact pieces disposed so as to conjointly define a gap therebetween. A follower contact is arranged on one of the contact pieces in insulated relation thereto so as to be movable in a direction toward the other one of the contact pieces. A bridging contact member is movable between first and second positions for electrically joining the contact pieces in the first position and for running off of the one contact piece when moved in the direction toward the other contact piece to the second position thereby electrically separating the contact pieces. Electromagnetic actuator means develops a force to propel the follower contact along the above-mentioned direction in the opening operation of the breaker. Resilient means is associated with the follower contact for receiving resilient energy as the actuator means propels the follower contact in the above-mentioned direction. Current supply means supplies the current to be interrupted to the one contact piece. The follower contact is connected to the current supply means through the electromagnetic actuator means to define a bypass conducting path. The follower contact is arranged in the one contact piece so as to cause the bridging contact member to contact the follower contact when the bridging contact member runs off of the one contact piece thereby commutating the current to the bypass conducting path whereby the electromagnetic actuator means becomes energized to develop the force.

The electromagnetic actuator means can include two coaxial coils. One of the coils is fixedly mounted on the breaker and the other one of the coils is mechanically connected to the follower contact. The coils are part of the bypass conducting path and develop the abovementioned force therebetween in response to the current commutated to the bypass conducting path. The resilient means can be a spring arranged so as to be stressed as the follower contact is moved in the abovementioned direction under the force developed by the coils.

The follower contact moves a predetermined distance in the direction of the other contact piece under the force developed in the coils by the current commutated to the follower contact. The follower contact prevents the gap from being opened when the current to be interrupted by the breaker is high.

The circuit breaker according to the invention switches quasi-synchronously at high currents because the follower contact keeps the switching gap almost or completely closed until the current to be interrupted has dropped to a low value shortly before its zero crossing.

In a preferred embodiment of the invention, the contact arrangement includes two hollow-cylindrical, fixed contacts. The hollow-cylindrical follower contact is likewise of hollow-cylindrical configuration and is disposed within the one contact in telescope-fashion. In other words, the one contact here forms a guide for the follower contact so that the assembly is particularly simple. According to another feature of the invention, the one coil may be flanged to the end of the follower contact facing away from the switching gap and be supported on one side by means of a compression spring against the corresponding end of the one contact while its other side is opposite a stationary coil, through which the current flows in the opposite sense.

The invention is of particular significance for blast-piston circuit breakers (single stage breakers); however, it is also applicable to two-stage breakers wherein the quenching gas is stored in a high pressure chamber by means of a compressor and flows into a low pressure chamber during the switching operation.

Although the invention is illustrated and described herein as a contact arrangement for an electric pressure-gas power circuit breaker, it is nevertheless not intended to be limited to the details shown, since various modifications may be made therein within the scope and the range of the claims. The invention, however, together with additional objects and advantages will be best understood from the following description and in connection with the accompanying drawing.

BRIEF DESCRIPTION OF THE DRAWING

The drawing illustrates schematically, in longitudinal section, a pressure-gas circuit breaker equipped with a contact arrangement according to the invention. The portion of the drawing to the left of the center line shows the contact arrangement in the closed position whereas, the portion of the drawing to the left of the center line shows the contact arrangement in the open position.

The high-voltage breaker shown can be suitable for operating at 110 KV for example and utilize sulfur-hexafluoride as the quenching and insulating gas. The drawing shows only those components necessary to understand the contact arrangement according to the invention. The parts of the breaker at ground potential, the drive system and the support insulators are not shown.

DESCRIPTION OF THE PREFERRED EMBODIMENTS OF THE INVENTION

The breaker includes a switching chamber 1 made of porcelain for example. The switching gap is defined by the fixed contacts 3 and 4 which are of hollow-cylindrical configuration for the discharge of the quenching gas. The fixed contact 3 is connected to current supply means which includes a breaker terminal 2 represented schematically in the drawing. The fixed contact 4 is connected to a terminal 5.

In the contact-making position shown on the right-hand side of the drawing, the two fixed contacts 3 and 4 are connected by a tubular bridging contact member 6. Mounted inside the bridging contact member 6 are spring-loaded fingers 7 whose contact surfaces 8 are pressed against the contact pieces 3 and 4 with a predetermined contact pressure. The bridging contact member 6 supports a slide contact ring 9 of an arc-resistant, electrically conducting material, an electrical insulation 10 being interposed. The bridging contact member 6 is screwed into a coupler fitting 18 which, in turn, is connected by fastening element 19 to a tube 20 of insulating material which forms a blast cylinder.

The end face 21 of the blast cylinder supports a nozzle body which surrounds the fixed contact 3. The insulating tube 20 is produced, for example, as one piece such as of fiber-reinforced plastic. During the breaking motion, the insulating tube 20, together with the bridging contact member 6, is pulled over a relatively stationary piston 24 so that a supply of pressurized quenching medium is made available. The coupler fitting 18 is engaged by pull rods 12 pivotally connected on pin 13. Coupled to the pull rods 12 is an actuator drive (not shown) which moves the breaker from the contact-making position shown to the right of the center line into the contact-breaking position shown to the left of the center line. During this motion, the bridging contact member 6 runs off of the fixed contact 3 (run-off contact) in a downward direction.

Associated with the run-off contact 3 is a follower contact 11 which, like the contact 3, is of tubular configuration and can slide in contact 3 in a telescope-like fashion with an insulating layer 14 being interposed therebetween. The outer end of the follower contact 11 is mechanically connected to a coil 15 arranged in a flange-like manner. The coil 15 is supported by resilient means in the form of a spring 16 against the outer end *3a* of the fixed contact 3 which is likewise of flange-like configuration. Directly next to the coil 15 there is another coil 17 arranged at a fixed location. The terminal 2 of the breaker is connected to the follower contact 11 through a branch 22 and the coils 15 and 17 which are wired in series in the opposing sense. The mutually adjacent end-faces of the follower contact 11 and of the fixed contact 4 are of nozzle-shaped configuration.

The switching chamber 1 is filled completely with sulfur hexafluoride and pressurized to four atmospheres, for example. For contact-breaking, the bridging contact member 6, together with the insulating tube 20, moves downward from its up position. This compresses the sulfur hexafluoride contained in the insulating tube 20 because, at the start of the contact-breaking motion, it is not yet able to flow off.

After the insulating tube 20 has traveled approximately half of its stroke, the contact fingers 7 of the bridging contact member and the slide contact ring 9 slide off the fixed contact 3 and immediately thereafter make contact with the follower contact 11. The consequence thereof is that the current to be interrupted is commutated to the bypass circuit 2-22-17-15-11. This produces a repulsion force between the coils 17 and 15 through which the current flows in the opposite sense. If the current is large enough, this force is stronger than the counterforce of the compression spring 16 so that the coil 15 is moved into the position 15' represented in phantom thereby shortening the spring 16 and causing the follower contact 11 to be moved in the direction toward the fixed contact 4 into the position 11' also shown in phantom. Thus, coils 15 and 17 conjointly define electromagnetic actuator means for developing a force to propel said follower contact along the above-mentioned direction.

At first, no opening of the switching gap comes about when the bridging contact member 6 runs off of the fixed contact 3 because, in its position 11', the follower contact 11 keeps the switching gap completely or almost closed. It is only after the current to be interrupted has reached a sufficiently low value near its zero crossing that the counterforce of the spring 16 predominates so that the follower contact 11 returns into its position shown in solid outline. From this instant on, the sulfur hexafluoride compressed inside the insulating tube 20 can flow into the nozzles formed by the contacts 4 and 11.

Appropriate dimensioning of the spring 16 and of the coils 15 and 17 enables determination of the instantaneous value of the current at which the follower contact 11 just starts to move during the breaking process. Above this instantaneous value, the breaker operates quasi-synchronously in the sense that an effective opening of the switching gap occurs only in the descending part of the current half-wave below a given current value.

The stationary coil 17 may be disposed below the movable coil 15, and the current may flow through the coils in the same sense so that an attraction force is produced between them at high current.

The invention is not restricted to the embodiment example shown in the form of a blast-piston breaker. In a two-stage breaker, for example, the contacts 11 and 4 could be solid and operate with a lateral quenching gas flow.

What is claimed is:

1. A contact arrangement for an electric pressure-gas circuit breaker for interrupting an electric current comprising: two stationary contact pieces disposed so as to conjointly define a gap therebetween; a follower contact disposed on one of said contact pieces in insulated relation thereto and movable in a direction toward the other one of said contact pieces; a bridging contact member movable between first and second positions for electrically joining said contact pieces in said first position and for running off of said one contact piece when moved in said direction toward said other contact piece to said second position thereby electrically separating said contact pieces; electromagnetic actuator means for developing a force to propel said follower contact along said direction in the opening operation of the breaker; resilient means connected to said follower contact receiving resilient energy as said actuator means propels said follower contact in said direction; current supply means for supplying current to said one contact piece; said follower contact being connected to said current supply means through said electromagnetic actuator means to define a bypass conducting path, said follower contact being disposed on said one contact piece so as to cause said bridging contact member to contact said follower contact when said bridging contact member runs off of said one contact piece thereby commutating said current to said bypass conducting path whereby said electromagnetic actuator means becomes energized to develop said force.

2. The contact arrangement of claim 1, said electromagnetic actuator means comprising: two coaxial coils, one of said coils being fixedly mounted on a circuit breaker and the other one of said coils being mechanically connected to said follower contact, said coils being part of said bypass conducting path to develop said force therebetween in response to the current commutated to said bypass conducting path, and said resilient means being a spring arranged so as to be stressed as said follower contact is moved in said direction under said force.

3. The contact arrangement of claim 2, said stationary contact pieces each being configured as a hollow cylindrical member, and said follower contact also being configured as a hollow cylindrical member and being arranged so as to be movable telescopically within said one contact piece.

4. The contact arrangement of claim 3, said follower contact having an end-face facing away from said gap, said other one of said coils being mounted flange-like on said end-face of said follower contact, said other coil being braced with respect to said one contact piece by said spring, said other one of said coils being arranged adjacent said one coil of said coils, said coils being connected in said bypass conducting path so that the current flows through said one coil in a sense opposite to the sense in which the current flows through said other coil.

5. The contact arrangement of claim 2 wherein said breaker is a blast-piston type circuit breaker.

* * * * *